US005997202A

United States Patent [19]

Durocher

[11] Patent Number: 5,997,202

[45] **Date of Patent: *Dec. 7, 1999**

[54] PACKAGE FOR STICK PRODUCT

[75] Inventor: Philip Claude Durocher, Thornhill, Canada

[73] Assignee: Colgate-Palmolive Company, New York, N.Y.

[ * ] Notice: Under 35 U.S.C. 154(b), the term of this patent shall be extended for 95 days.

[21] Appl. No.: 08/607,915

[22] Filed: Feb. 28, 1996

[51] Int. Cl.[6] ..... A45D 40/02

[52] U.S. Cl. ..... 401/83; 401/84

[58] Field of Search ..... 401/82, 83, 84

[56] References Cited

U.S. PATENT DOCUMENTS

| | | | |
|---|---|---|---|
| 1,245,739 | 11/1917 | Krell | 401/84 |
| 1,494,736 | 5/1924 | Cottrell . | |
| 1,983,083 | 12/1934 | Irelan . | |
| 2,071,747 | 2/1937 | Houlihan | 401/83 |
| 2,415,306 | 2/1947 | Rich | 401/82 |
| 2,762,336 | 9/1956 | Estes | 401/83 |
| 2,770,358 | 11/1956 | Keith | 401/83 |
| 3,902,814 | 9/1975 | Cardia . | |
| 4,500,221 | 2/1985 | Emerson | 401/84 X |
| 4,815,485 | 3/1989 | Morel | 401/82 X |
| 5,167,462 | 12/1992 | Lucas . | |

FOREIGN PATENT DOCUMENTS

| | | | |
|---|---|---|---|
| 442004 | 8/1991 | European Pat. Off. | 401/84 |
| 804576 | 10/1936 | France . | |
| 824808 | 2/1938 | France . | |
| 2222047 | 10/1974 | France . | |
| 3634621 | 4/1988 | Germany . | |
| 122565 | 1/1919 | United Kingdom . | |
| 90/01006 | 2/1990 | WIPO . | |

*Primary Examiner*—Steven A. Bratlie
*Attorney, Agent, or Firm*—Michael McGreal

[57] ABSTRACT

A package for a solid stick product, including barrel for containing the stick product and, provided within the barrel, a product support member for supporting the stick product thereon. The product support member is movable in the longitudinal direction of the barrel for raising and lowering the stick product. The barrel has a longitudinally extending slot through a wall thereof. An adjustment button is provided on the outside of the barrel and is movable in the longitudinal direction of the barrel generally over the slot area. A tab extends through the slot and connects the adjustment button to the product support member, whereby movement of the adjustment button outside the barrel brings about an equivalent translational movement of the product support member and, therefore, the stick product within the barrel. Thus, by raising or lowering the adjustment button outside the barrel, the user can raise or lower the stick product to extract the product from or retract the product within the barrel. The package includes a locking mechanism for locking the product support member and preventing movement of the product support member in the longitudinal direction.

7 Claims, 3 Drawing Sheets

PACKAGE FOR STICK PRODUCT

BACKGROUND OF THE INVENTION

The present invention is directed to a package for a stick type product (e.g., a solid stick product, especially a solid cosmetic stick product such as an antiperspirant or deodorant stick, lip balm, insect repellent, etc.).

A conventional package for a solid stick product, such as a conventional antiperspirant or deodorant stick package, comprises a barrel for containing the antiperspirant or deodorant stick. The barrel has an opening through which a first end of the stick can be exposed for use. A second, opposite end of the antiperspirant or deodorant stick is supported on a movable product support member within the barrel. The product support member can be moved by pushing or with the use of a screw feed mechanism, for example, for adjusting the amount of antiperspirant or deodorant stick which extends beyond the barrel opening. Thus, the user adjusts the stick relative to the barrel until the end of the stick protrudes through the opening of the barrel a sufficient distance for rubbing the end of the stick against the underarm.

U.S. Pat. No. 5,167,462 to Lucas discloses an applicator for solidified products. This patent discloses a driving mechanism provided for to and fro translation of the product in order to extract and retract it. The driving mechanism is intended to overcome problems encountered in using known screw-type mechanisms and enable the user to operate the mechanism with one hand. The mechanism comprises a support base for the product which is movably mounted in a hollow case body and is provided with an extension that extends opposite to the product and is adapted to be engaged with an element affixed to a cursor by a connection tab that passes through the body. The cursor is arranged in a movable manner outside the body in such a way that activation of the cursor brings about an equivalent translational movement of the base and thus of the product. However, other than an extreme extracted and retracted position, this patent does not appear to describe any mechanism for locking the support base and solidified product in a particular position. Therefore, when such an applicator is used to apply a cosmetic stick product, e.g., to apply a deodorant or antiperspirant stick product to the underarm area, the force exerted on the applicator against the underarm will tend to push the stick product back into the applicator body. This is an inconvenience to the user who must continually upwardly adjust the product.

SUMMARY OF THE INVENTION

The present invention solves the problems of prior art stick packages and provides a package for a stick product which is easy to operate and which enables the user to adjust the height of the stick product which extends beyond the barrel opening and lock the product in place.

These advantageous results are achieved by a package including a barrel for containing the stick product and, provided within the barrel, a product support member for supporting the stick product thereon. The product support member is movable in the longitudinal direction of the barrel for raising and lowering the stick product. The barrel has a longitudinally extending slot through a wall thereof. An adjustment button is provided on the outside of the barrel and is movable in the longitudinal direction of the barrel generally over the slot area. A tab extends through the slot and connects the adjustment button to the product support member, whereby movement of the adjustment button outside the barrel brings about an equivalent translational movement of the product support member and, therefore, the stick product within the barrel. Thus, by raising or lowering the adjustment button outside the barrel, the user can raise or lower the stick product to extract the product from or retract the product within the barrel. The package of the present invention includes a locking mechanism for locking the product support member and preventing movement of the product support member in the longitudinal direction.

According to a preferred embodiment of the present invention, the barrel includes at least one post extending longitudinally within the barrel from a bottom of the barrel. The product support member in this embodiment includes a platform for supporting the stick product on a top surface thereof and an extension extending in the longitudinal direction of the barrel from a bottom surface of the platform. The extension has a longitudinally extending bore in which the post is slidable. The tab which connects the adjustment button to the product support member is connected, in this embodiment, to the extension.

According to the preferred embodiment, the locking mechanism is connected to the adjustment button on the outside of the barrel. The locking mechanism has an unlocked position allowing full movement of the adjustment button and a locked position preventing movement of the adjustment button and, therefore, of the product support member and product supported thereon.

In the preferred embodiment, the locking mechanism comprises a pair of resilient arms provided on the adjustment button, each of the resilient arms bearing a detent. The resilient arms and the detents provided thereon are slidable in a longitudinally extending groove provided in an outside wall of the barrel around the slot. The walls of the groove have a corrugated profile. The locking mechanism also comprises a locking tab provided on the locking button, the locking button and locking tab provided thereon being slidable between the unlocked position and the locked position. In the locked position, the locking tab is positioned between the two detents forcing the detents into a pair of opposed concave recesses of the corrugated side walls of the grooves, thereby preventing movement of the adjustment button.

DETAILED DESCRIPTION OF THE PREFERRED EMBODIMENT

Figure 1:
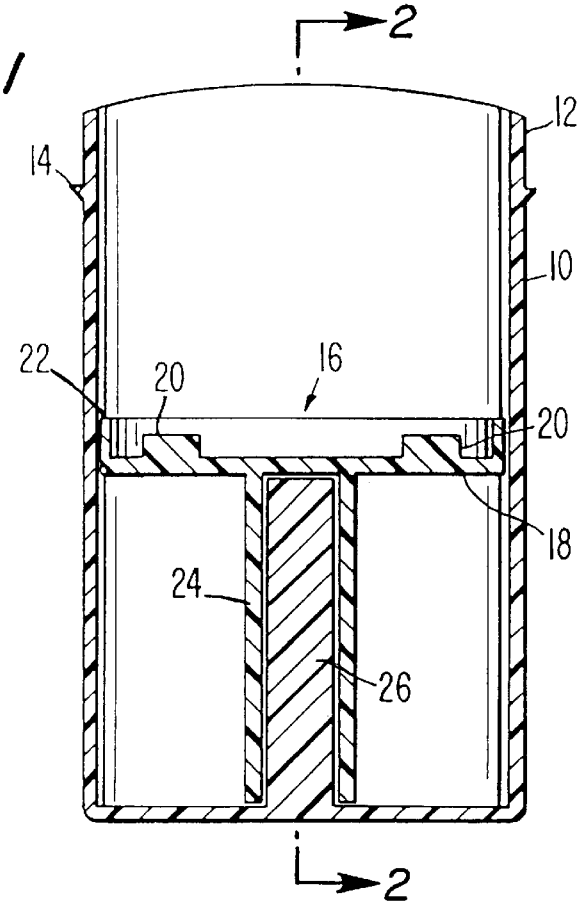
FIG. 1 is a cross-sectional view of the package of the present invention.

The embodiment shown in the drawings represents the preferred embodiment of the present invention and will be described in connection with a package especially designed for a deodorant stick. However, it will be recognized that the present invention is not limited to the embodiment shown or to use in connection with deodorant sticks but is susceptible to numerous changes or modifications as would be understood by those skilled in the art.

Figure 2:
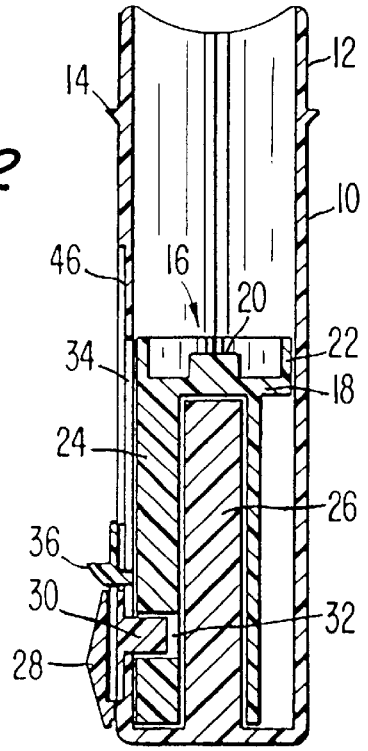
FIG. 2 is a cross-sectional view of the package taken along line II—II of FIG. 1.

Referring to FIGS. 1 to 4, the package of the present invention includes a hollow barrel 10. For packaging an antiperspirant or deodorant stick product, the barrel 10 has a substantially oval or elongated elliptical horizontal cross-section. The barrel 10 has an upper end 12 to which is fitted a cap (not shown) which may rest, when closed, on ledge 14 of barrel 10. As best shown in FIGS. 1 and 2, the package includes a product support member generally designated by the reference numeral 16. The product support member 16 includes a platform 18 on which the deodorant stick is supported. Preferably, the platform 18 includes tabs 20 which serve to fix the solidified deodorant stick on the platform 18. Preferably, the product support member 16 also includes a raised wall 22 which serves both to secure the solidified stick product on the platform 18 and to prevent leakage of the product out of the package while the liquid product is being filled in the package during a top-fill operation, which operation is known in the art.

The product support member 16 includes an extension 24 extending from a bottom surface of the platform 18, the extension 24 having an opening therein in which a post 26 which extends longitudinally from a bottom of the barrel 10 may slide. Thus, the extension 24 can slide upwardly and downwardly on post 26 for raising and lowering the product support member 16 to extract and retract the deodorant stick out of and into the upper end 12 of barrel 10. The length of the post 26 and extension 24 can be adjusted to adjust the volume of deodorant stick product in the barrel 10.

Figure 3:
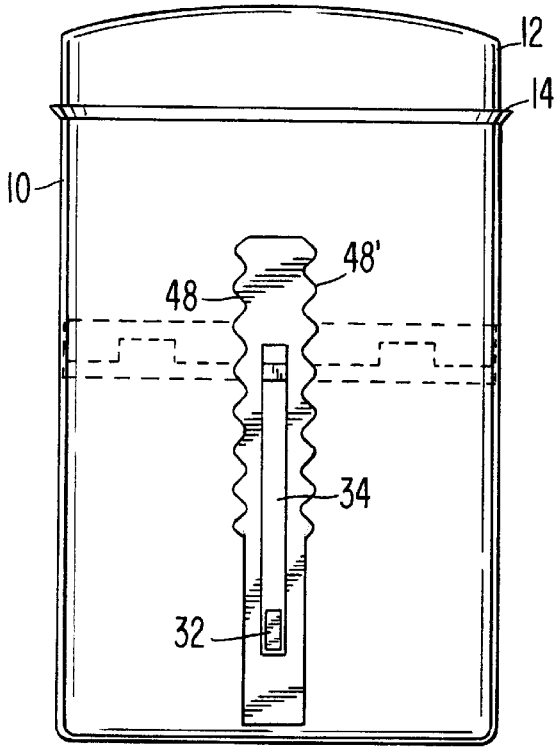
FIG. 3 is a front elevational view of the package with the adjustment button and locking button removed.
Figure 4:
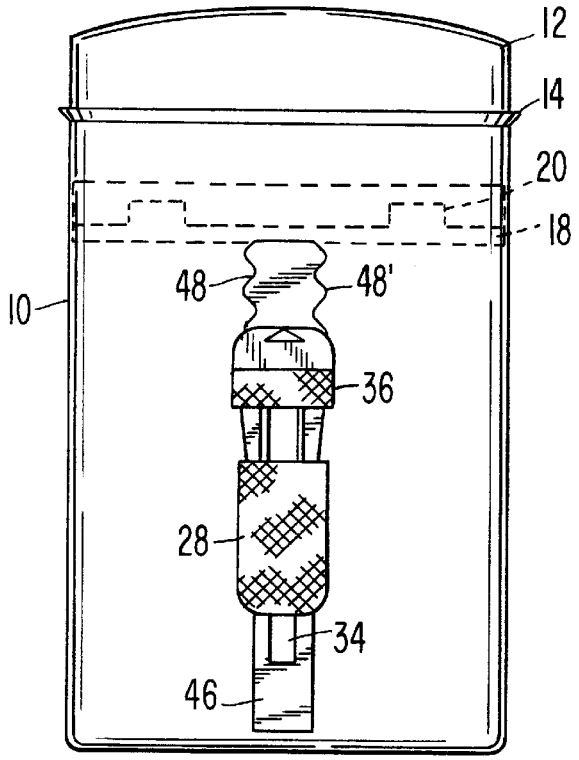
FIG. 4 is a side elevational view of the package showing the adjustment button in a raised position and showing the locking button in a locked position.

As can best be seen from FIG. 2, an adjustment button 28 is provided on an outside wall of barrel 10 and includes a tab 30 which is received in recess 32 of extension 24 of the product support member 16. The tab 30 extends through slit 34 which extends longitudinally through the front wall of the barrel 10, as can best be seen in FIG. 3. As shown in FIGS. 2 and 4, a locking button 36 is also provided on the outside of the front wall of barrel 10.

Figure 5:
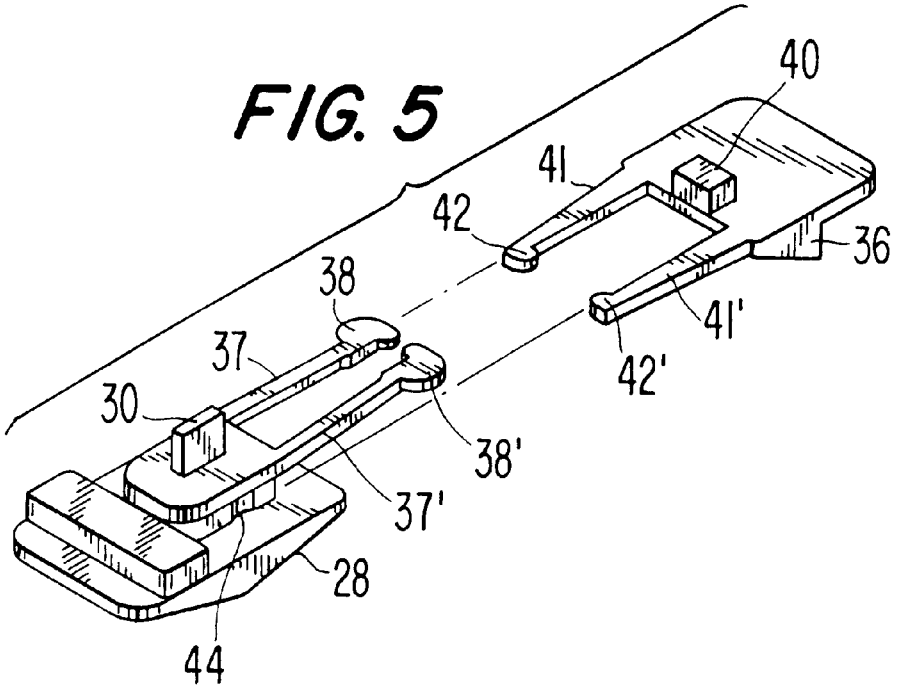
FIG. 5 is an exploded perspective view of the adjustment button and locking button, showing elements of the locking mechanism.
Figure 6A:
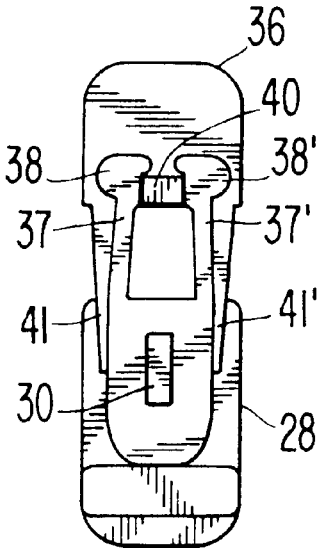
FIGS. 6A and 6B are rear elevational views of the adjustment button and locking button in the locked and unlocked positions, respectively.
Figure 6B:
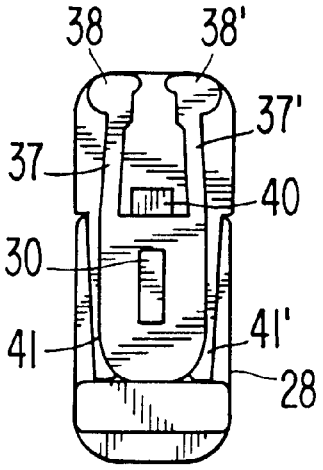

The relationship between adjustment button 28 and locking button 36 and the manner in which the adjustment button 28 and locking button 36 cooperate to provide a locking mechanism are shown in FIG. 5 and FIGS. 6A and 6B. As shown in FIGS. 5, 6A and 6B, the adjustment button 28 includes a pair of resilient arms 37, 37', the ends of which bear detents 38, 38', respectively. On the other hand, the locking button 36 bears a locking tab 40 which is slidable between the resilient arms 37, 37'. In the unlocked position, shown in FIG. 6B, the locking tab 40 is disengaged from the detents 38, 38' allowing the detents 38, 38' to be moved towards each other on resilient arms 37, 37'. In the locked position, shown in FIG. 6A and FIG. 4, the locking tab 40 is slid into engagement between detents 38, 38' preventing the detents from moving towards one another and providing a locking effect, as will be described hereinafter. Locking button 36 is movable with respect to adjustment button 28 and is engaged therewith by means of resilient arms 41, 41' on locking button 36 and detents 42, 42', which engage with recesses 44 on adjustment button 28 as best shown in FIG. 5. As shown in FIGS. 2 to 4, the front outside wall of barrel 10 includes a groove 46. As can be seen in FIGS. 3 and 4, the groove 46 has side walls 48, 48' having a corrugated profile. When locking button 36 is in the locked position shown in FIG. 6A and FIG. 4, detents 38, 38' of adjustment button 28 are forced into a pair of opposed recesses of the corrugated profile of sidewalls 48, 48' of groove 46. This prevents movement of the adjustment button 28 and, therefore, of product support member 16 and the products supported thereon.

As can be appreciated, in order to extract the deodorant stick from the top end 12 of the barrel 10, the user merely pushes adjustment button 28 upwardly while locking button 36 is in the unlocked position (shown in FIGS. 2 and 6B). When the stick has been extracted to a predetermined height above upper end 12 of barrel 10, the user may lock the stick in place by extending locking button 36 upwardly away from adjustment button 28, causing locking tab 40 to slide between detents 38, 38', forcing detents 38, 38' into opposed concave recesses of corrugated side walls 48, 48' of groove 46, thereby locking the adjustment button 28 and product support member 16 in place. The locking mechanism can be unlocked by sliding locking button 36 downwardly towards adjustment button 28. In this position, the adjustment button 28 can be moved upwardly or downwardly in groove 46 since detents 38, 38' are not locked in recesses of side walls 48, 48' but are free to be pushed toward one another on resilient arms 37, 37'.

The package of the present invention has applicability not only as a package for antiperspirant or deodorant stick products but also to any other solid stick-type products, especially products having a waxy consistency, such as lip balm, insect repellent, etc.

While preferred embodiments of the present invention have been described, it is understood that the present invention is not limited thereto, but is susceptible to numerous changes and modifications as known to those skilled in the art. Therefore, the present invention is not limited to the details shown and described herein, but covers all such changes and modifications as are encompassed by the scope of the appended claims.

What is claimed is:

1. A package for a stick product, comprising:

a barrel for containing the stick product, the barrel having a slot through a wall thereof, the slot extending in a longitudinal direction of the barrel and having a plurality of slot detents disposed laterally onto each edge of the slot;

a product support member for supporting the stick product thereon, said product support member being movable in the longitudinal direction within the barrel for raising and lowering the stick product to be supported thereon;

an adjustment button movable along an outside wall of said barrel adjacent the slot with a tab extending through the slot and connecting said adjustment button to the product support member; and a locking mechanism for locking the product support member and preventing movement thereof in the longitudinal direction comprising at least two resilient arms on the adjustment button extending longitudinally in the slot, locking detents on the resilient arms adjacent an end thereof, the locking detents engaging the slot detents to maintain the adjustment button and thus the product support member at a given position.

2. A package for a stick product as in claim 1 comprising a locking button cooperating with the adjustment button, the resilient arms extending toward the cooperating locking button, the locking button having a locking tab adapted to engage the resilient arms and move the resilient arms outwardly whereby the locking detents on the resilient arms engage the slot detents.

3. A package for a stick product as in claim 2 wherein the locking button moves towards and away from the adjustment button whereby the resilient arms disengage and engage the locking tab.

4. A package for a stick product as in claim 1 wherein the barrel has a front surface and rear surface greater in surface area than a side surface.

5. A package for a stick product as in claim 4 wherein the slot is in one of the front surface and the rear surface.

6. A package for a stick product as in claim 1 wherein the stick product is a deodorant.

7. A package for a stick product as in claim 1 wherein the stick product is an antiperspirant.

* * * * *